US005123525A

United States Patent [19]

Orlowski

[11] Patent Number: 5,123,525

[45] Date of Patent: Jun. 23, 1992

[54] EYEGLASS CASE

[76] Inventor: Daniel E. Orlowski, 2336 W. Deerfield Dr., Media, Pa. 19063

[21] Appl. No.: 676,425

[22] Filed: Mar. 28, 1991

[51] Int. Cl.[5] ..... B65D 85/38; A45C 11/04

[52] U.S. Cl. ..... 206/5; 24/3 G; 224/252

[58] Field of Search ..... 24/3 F, 3 G, 3 H, 3 R; 206/5, 6; 224/194, 230, 252, 253, 271

[56] References Cited

U.S. PATENT DOCUMENTS

| | | | |
|---|---|---|---|
| 1,303,485 | 5/1919 | Lindeman . | |
| 1,633,417 | 6/1927 | Perry . | |
| 1,638,727 | 8/1927 | Dadourian . | |
| 1,842,599 | 1/1932 | Fraser . | |
| 2,187,177 | 1/1940 | Schutz | 206/6 |
| 2,262,340 | 11/1941 | Shalko | 24/3 G |
| 2,370,967 | 3/1945 | Junkin | 206/6 |
| 2,473,292 | 6/1949 | Nathan | 206/6 |
| 2,650,701 | 9/1953 | Parsell | 206/6 |
| 2,657,791 | 11/1953 | Grosvenor | 206/6 |
| 2,800,695 | 7/1957 | Stegeman | 24/3 G |
| 3,091,378 | 5/1963 | O'Dwyer | 224/252 |
| 3,097,406 | 7/1963 | Yarborough | 24/3 G |
| 3,921,797 | 11/1975 | Platt | 206/6 |
| 3,937,373 | 2/1976 | Artz | 224/252 |
| 4,267,923 | 5/1981 | Baratelli et al. | 206/6 |
| 4,667,374 | 5/1987 | Bianchi | 224/252 |
| 4,705,086 | 11/1987 | O'Neill | 224/252 |
| 4,821,934 | 4/1989 | Alessi et al. | 224/252 |
| 4,903,745 | 2/1990 | Roman | 224/252 |
| 4,915,215 | 4/1990 | Brekke | 24/3 G |

*Primary Examiner*—Jimmy G. Foster
*Attorney, Agent, or Firm*—Eugene E. Renz, Jr.

[57] ABSTRACT

Case for eyeglasses and the like which includes a clip for securing the case to a pocket or other object. The clip is secured to the case at a position other than on the exterior of the case.

6 Claims, 2 Drawing Sheets

EYEGLASS CASE

FIELD OF THE INVENTION

This invention relates to a case for eyeglasses and the like which includes a clip for attaching the case to an object and, more specifically, to an eyeglass case and clip wherein the clip is attached to the case at a location other than on the exterior of the case.

BACKGROUND OF THE INVENTION

Eyeglass cases, in general, are well known. Such cases provide protection to eyeglasses when they are not being worn. Many eyeglass cases include a device, such as a clip, to secure the case in, for example, a person's pocket, brief case, purse, etc. Typically, such clips are made of flexible metal and covered with the same material which forms the outside of the case, such as vinyl or leather. The clip is attached to the exterior of the case either by glue, sewn thread or the like. This exterior attachment of the clip makes the eyeglass case somewhat unattractive. The present invention improves the appearance of eyeglass cases by providing a clip which is not attached to the exterior of the case.

U.S. Pat. No. 1,303,485, discloses an eyeglass case which includes apparatus for preventing a chain attached to the glasses from becoming entangled with the nose piece or other part of the glasses.

U.S. Pat. No. 1,633,417, discloses an eyeglass case which includes a highly polished surface which is adapted to be place in contact with the lenses of the eyeglasses to prevent scratching of the lenses.

U.S. Pat. No. 1,638,727, discloses an eyeglass case which includes openings for the ear pieces of the glasses to project through thereby allowing the overall construction of the eyeglass case to be of smaller dimensions that if the ear pieces were enclosed.

U.S. Pat. No. 1,842,599 discloses an eyeglass case which includes a resilient metal plate for facilitating the insertion or removal of eyeglasses and for retaining the eyeglasses within the interior of the case.

U.S. Pat. No. 2,187,177, discloses an eyeglass case which includes a flexible web on which the eyeglasses lie and are supported.

U.S. Pat. No. 2,370,967, discloses a box which is constructed from a single piece of cardboard, heavy paper or the like, for the storage of eyeglasses.

U.S. Pat. No. 2,473,292, discloses a case which is formed from a single piece of flexible material and folded to assume the desired shape for the storage of eyeglasses.

U.S. Pat. No. 2,650,701, discloses an eyeglass case which includes lens cleaning elements.

U.S. Pat. No. 2,657,791, discloses and eyeglass case which includes and interior band along the longitudinal extent of the case for supporting eyeglasses therein.

U.S. Pat. No. 3,921,797, discloses a disposable eyeglass case which includes silicon treated tissue for cleaning the lenses of eyeglasses.

U.S. Pat. No. 4,267,923, discloses an eyeglass case with an interior separator which prevents the temple tips of eyeglasses from contacting and rubbing against the lenses.

SUMMARY OF THE INVENTION

Apparatus is provided for attaching a first object to a second object which includes a first object with a first surface defining the exterior of the first object and second surface which is distinct from the first surface and attachment apparatus connected to the second surface for attaching the first object to the second object.

Also provided is a case for eyeglasses and the like which includes cover apparatus with an exterior surface and second surface for removably securing the eyeglasses and attachment apparatus with a portion connected to the second surface and a portion adjacent the exterior surface for attaching the cover apparatus to an object.

Additionally provided is a case for eyeglasses and the like which includes covering apparatus with an exterior surface for removably securing the eyeglasses and attachment apparatus connected to the covering apparatus at a location other than on the exterior surface for attaching the covering apparatus to an object.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
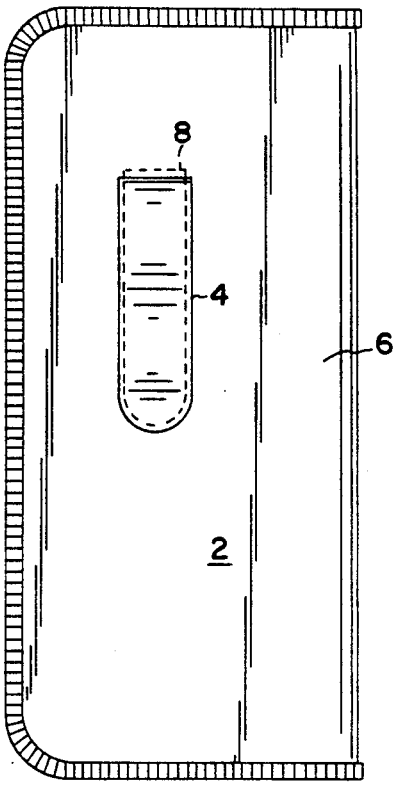
FIG.1 PRIOR ART
FIG. 1 is a front elevational view of the prior art eyeglass case.
Figure 2:
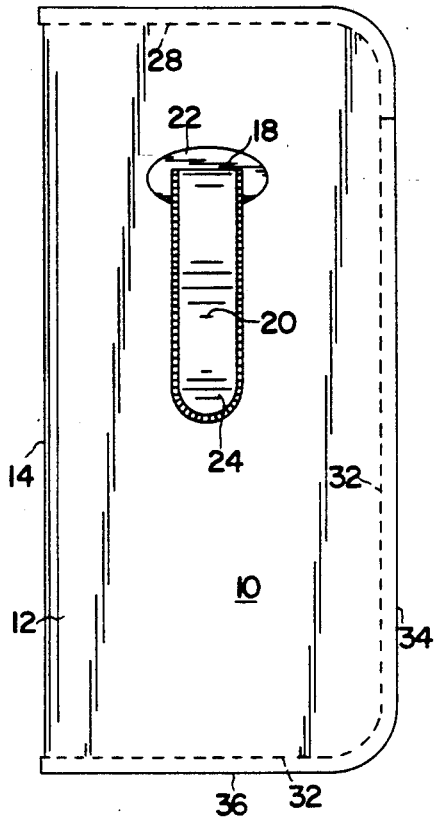
FIG. 2 is a front elevational view of the present invention.
Figure 3:
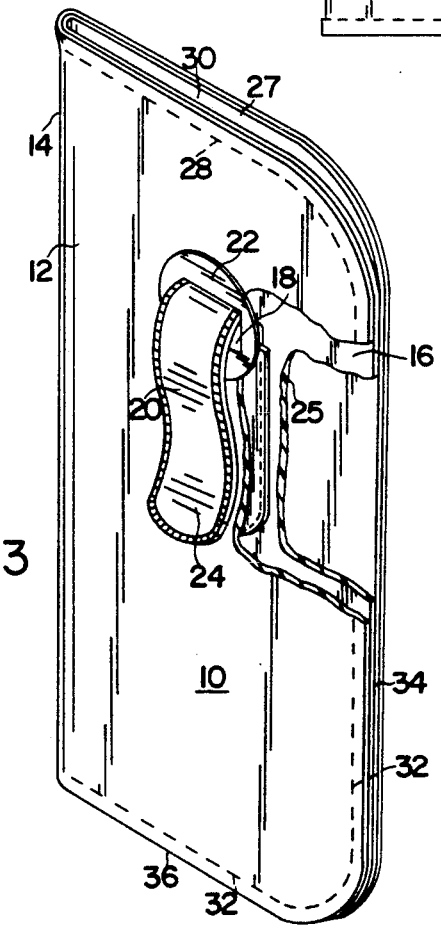
FIG. 3 is a perspective view, partially in section, of the apparatus of FIG. 2.

FIG. 1 shows prior art eyeglass case 2 which includes clip 4. Clip 4 is attached to exterior surface 6 of case 2 by any of several well-known means such as stitching 8, glue (not shown) and the like. The construction of case 2, and the attachment of clip 4, is well known to those of ordinary skill in the art. While the eyeglass case of FIG. 1 is functional, it does not present an attractive appearance.

FIG. 2 through 5 show the apparatus of the present invention. In the preferred embodiment of the invention, eyeglass case 10 includes exterior cover 12 which is, preferably, a single piece of a durable, visually pleasing material such as leather or vinyl. Adjacent exterior cover 12 is inner panel 16. Exterior cover 12 defines opening 18 through which clip 20 is positioned. Opening 18 is, preferably, reinforced by ring 22 which is made of a rigid material such as metal.

Figure 4:
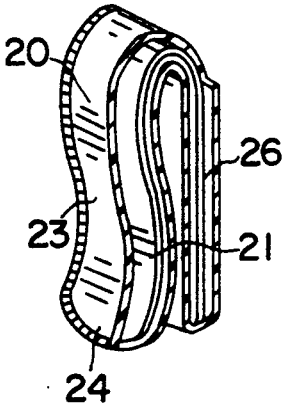
FIG. 4 is a sectional view of the inner panel of the apparatus of FIG. 2.

FIG. 4 shows a detail of the construction of clip 20. Clip 20 is, preferably, constructed from a somewhat flexible, spring-like piece of metal 21, which is formed in somewhat of a "U" shape and covered with a visually appealing material 23. Clip 20 includes exterior projection 24 and interior portion 26.

Figure 5:
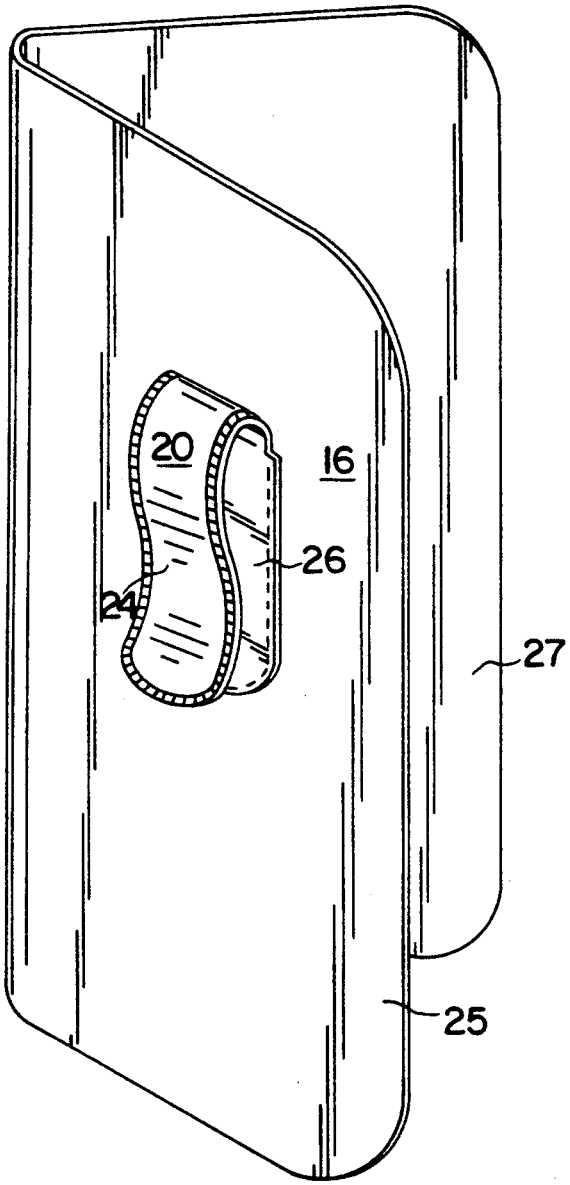
FIG. 5 is a perspective view of the inner panel of the apparatus of FIG. 2.

FIG. 5 shows a detail of inner panel 16. Inner panel 16 is, preferably, formed from a flexible plastic type material such as polyvinyl chloride of the like, and is, generally, of the same dimensions as exterior cover 12. Clip 20 is attached to inner panel 16 by, preferably, sewing or gluing interior portion 26 to surface 25 of inner panel 16. This attachment may be made in the same manner that clip 4 is attached to the prior art case 2.

Inner panel 16 is relatively positioned with respect to exterior cover 12 by placing exterior projection 24 through opening 18. Interior portion 26 and the material used to attach clip 20 to inner panel 16 are, thus, interposed between surface 25 and exterior cover 12 are not visible. Inner panel 16 and exterior cover 12 are joined together through the use, preferably, of stitching 28. Exterior cover 12 and inner panel 16 are then folded along edge 14 and stitching 32 is applied along edges 34 and 36 to form pocket 30 which provides a receptacle for the storage of eyeglasses. Eyeglasses positioned within pocket 30 rest in contact with surface 27 of inner panel 16, which, preferably, is composed of a non-abrasive material to reduce the risk of scratching or otherwise damaging the eyeglasses.

An important aspect of the present invention is the manner in which clip 24 is attached to case 10. The present invention conceals unattractive clip attachment materials, such as stitching and glue, by interposing such materials between surface 25 of panel 16 and exterior cover 12. The present invention, therefore, markedly improves the appearance of case 10 by removing unattractive materials from view.

While, for purposes of clarity, certain parts of the invention have been described as being joined or connected by stitching, glue and the like, it is to be understood that other methods may be employed to join or connect such parts together with out compromising the effectiveness of the invention. Such other methods are well known to those of ordinary skill in the art.

Whereas particular embodiments of the invention have been described above for purposes of illustration, it will be evident to those skilled in the art that numerous variation of the details may be made without departing form the invention as defined in the appended claims.

What is claimed is:

1. An eyeglass case comprising:

inner and outer panels each having two opposed panel portions with a fold therebetween and connected along peripheral edges to define a pocket for eyeglasses;

an inner and outer panels having confronting first and second faces, and said outer panel having an opening; and a clip attached only to the first face of the inner panel and passing through said opening in the outer panel, said outer panel concealing from view the attachment of said clip to said inner panel.

2. An eyeglass case as claimed in claim 1 including a ring member made of a rigid material engageable over said clip and surrounding said opening to function as a reinforcing element.

3. An eyeglass case as claimed in claim 1 wherein said clip is of general U-shaped configuration including an interior portion attached to said first face of the inner panel and an exterior portion.

4. An eyeglass case as claimed in claim 1 wherein said clip is covered with a visually attractive material.

5. An eyeglass case as claimed in claim 1 wherein said inner panel is formed of a flexible plastic material, such as Polyvinyl Chloride.

6. An eyeglass case as claimed in claim 1 wherein said inner panel is preferably of a non abrasive material to reduce risk of scratching or otherwise damaging eyeglasses.

* * * * *